US006054920A

United States Patent [19]

Smith et al.

[11] Patent Number: 6,054,920

[45] Date of Patent: Apr. 25, 2000

[54] ALARM SYSTEM RECEIVER SUPERVISOR

[75] Inventors: David M. Smith; Rob Hendrickson, both of Minneapolis, Minn.

[73] Assignee: Interactive Technologies,Inc., North St. Paul, Minn.

[21] Appl. No.: 08/730,709

[22] Filed: Oct. 15, 1996

[51] Int. Cl.[7] ..... G08B 29/00

[52] U.S. Cl. ..... 340/506; 340/825.06; 340/539

[58] Field of Search ..... 340/506, 507, 340/539, 825.06, 825.07, 825.08, 825.1, 825.14, 825.21, 825.2

[56] References Cited

U.S. PATENT DOCUMENTS 4,772,876 9/1988 Laud ..... 340/539
4,988,989 1/1991 Goto ..... 340/825.21

*Primary Examiner*—Daryl Pope
*Attorney, Agent, or Firm*—D. L. Tschida

[57] ABSTRACT

A wireless sensor receiver module for an alarm and/or event reporting system having the capability of monitoring the operational integrity of associated wireless receiver circuitry relative to RF sensor transmissions. A receiver module supervisory timer is reset with the receipt of each sensor transmission, whether an event or supervisory transmission. If sensor transmissions are not received within a supervised receiver time period determined as a function of the number of system sensors, the receiver module communicates a receiver failure condition to the system controller. Noise monitoring circuitry separately monitors the transmissions to enhance the confidence in a receiver failure determination or adjust the period of the receiver module supervisory timer.

17 Claims, 9 Drawing Sheets

| ADDR | LEN=6 | Cmd | D1 | D2 | D3 | D4 | CHK |
|---|---|---|---|---|---|---|---|

FIG. 3

| ADDR | LEN=11 | Cmd | D1 | D2 | D3 | D4 | (D5 | D6) | (D7 | D8) | (D9) | CHK |
|---|---|---|---|---|---|---|---|---|---|---|---|---|

NOTE: D9 (OPTIONAL): RF RECEIVER STATUS

BIT 0 RX TAMPER, 1=TAMPER
BIT 1 RESET, 1= 1st POINT STATUS REPLY SINCE LAST RECEIVER RESET.
BIT 2 RX FAILURE, 1= NO SENSOR DATA RECEIVED FOR X HOURS, X IS CALCULATED AS SUPERVISOR INTERVAL / # OF SENSORS, MINIMUM 2 HOURS.

FIG. 4

ALARM SYSTEM RECEIVER SUPERVISOR

BACKGROUND OF THE INVENTION

The present invention generally relates to security alarm systems which include a plurality of distributed alarm sensors, and which communicate with a system controller at a protected premises. The system controller may communicate with an off-site central station.

The invention particularly relates to a wireless receiver module that is coupled to the system controller and which includes an ability to monitor the operational integrity of the wireless receiver circuitry and distinguish the malfunction of the receiver circuitry.

Over the years, varieties of alarm systems have been developed for reporting event or alarm conditions detected at sensors or transducers distributed about a protected premises. Most frequently, alarm conditions are reported via either hardwired or radio frequency communication links to a system controller at the monitored premises. The system controller, in turn, communicates on a prioritized basis with a central station which is responsive to a number of secured premises. Monitoring staff at the central station respond to the reported alarm and emergency conditions and route appropriate personnel and civil authorities.

Problems inherent in any alarm system are that communication failures can occur at the critical links between the distributed sensors and the system controller and between the system controller and the central station. System controller to central station communications are most typically monitored at the linking phone line connections. Loss of any phone connections to the central station or tampering, are readily detected.

Wireless and hardwired sensor communications to the system controller are most typically monitored by periodically checking the status of each sensor, such as during a supervisory reporting period, e.g. once every 12 or 24 hours. Provisions are not presently available for monitoring the integrity of receiver circuitry that is responsive to any wireless sensors within a system.

It is therefore desirable that either the system controller or an intervening wireless receiver module have an ability to monitor or supervise the operational integrity of the wireless receiver circuitry. The processor at the system controller can thereby be made aware of any defective wireless sensors as well as the operational integrity of the receiver circuitry.

The invention particularly provides a wireless receiver module having such a capability. The receiver module monitors wireless sensor communications (i.e. alarm or event and supervisory messages) in relation to a resettable first timer. The first timer has a period established in statistical relation to the number of wireless sensors in the system and which is presently determined as the ratio of 24 hours to the number of wireless sensors present in the system.

Separate timers monitor conventional supervisory communications from each of the wireless sensors to determine the integrity of each sensor. Failure to detect sensor transmissions within the period of the first timer produces a condition indicative of the failure of the receiver circuitry. Failure to detect normal supervisory communications from each sensor within the period of each of the second timers separately indicates individual sensor failure.

SUMMARY OF THE INVENTION

It is a primary object of the present invention to provide a security alarm system having an ability to determine the failure of associated wireless receiver circuitry which communicates with one or more wireless sensors in the system.

It is a further object of the invention to provide a system including the capability of monitoring wireless sensor communications in relation to a resettable receiver timer and wherein the period of the receiver timer is established as a function of the probability of the failure of the receiver circuitry versus the failure of multiple wireless sensors.

It is a further object of the invention to establish the period of the receiver timer as a ratio of 24 hours to the number of reporting sensors in the system.

It is a further object of the invention to provide noise monitoring capabilities to transmissions to improve the confidence in receiver failure detection.

It is a further object of the invention to provide nonvolatile memory in the system, e.g. $E^2$PROM memory space, which contains data that identifies the identity of all system sensors.

It is a further object of the invention to store the "current status" of each sensor in RAM and to provide separate "shuttle memory" space from which appropriate data is transmitted to the system controller and which data identifies the operating status of each of the wireless sensors and the receiver circuitry.

Various of the foregoing objects, advantages and distinctions of the invention are disclosed in a presently preferred alarm system which includes a number of sensors that are distributed about a monitored premises. Hardwired sensors are hardwired to a system controller at the site. Wireless sensors communicate with a wireless receiver module that is separately coupled to the system controller. The system controller, in turn, communicates with a central station via one or more telephone lines.

Each of the sensors is identifiable to the system through a sensor ID number. REM memory at the wireless receiver module and at the system controller are maintained to store the identity of each sensor assigned to the system as it reports, whether during an event initiated communication or a supervisory communication. A nonvolatile, $E^2$PROM memory at the system controller separately stores the identity of the system sensors in the event of a power failure and from which the system is restored.

The receiver module includes microprocessor controlled circuitry which monitors communications from each wireless sensor in relation to a number of resettable time periods to ascertain proper operation of the receiver circuitry and sensors. Data from wireless sensor transmissions are stored in memory which includes data to the identity, alarm state or missing status of each sensor. Data to the status of the receiver circuitry is also stored. The data is determined as a function of the number of sensor transmitters in the system. Separate noise monitoring at the receiver circuitry can be used to enhance the ability to distinguish receiver from sensor transmitter malfunction.

Still other objects, advantages and distinctions of the invention will become more apparent upon reference to the following detailed description with respect to the appended drawings. To the extent improvements and modifications have been considered, they are described as appropriate. The description should therefore not be literally construed in limitation of the invention. Rather, the invention should be interpreted within the spirit and scope of the appended claims.

BRIEF DESCRIPTION OF THE DRAWINGS

FIG. 3 shows the organization of an eight byte message from the shuttle memory.

FIG. 4 shows the organization of a thirteen byte message from the shuttle memory.

DESCRIPTION OF THE PREFERRED EMBODIMENT

Figure 1:
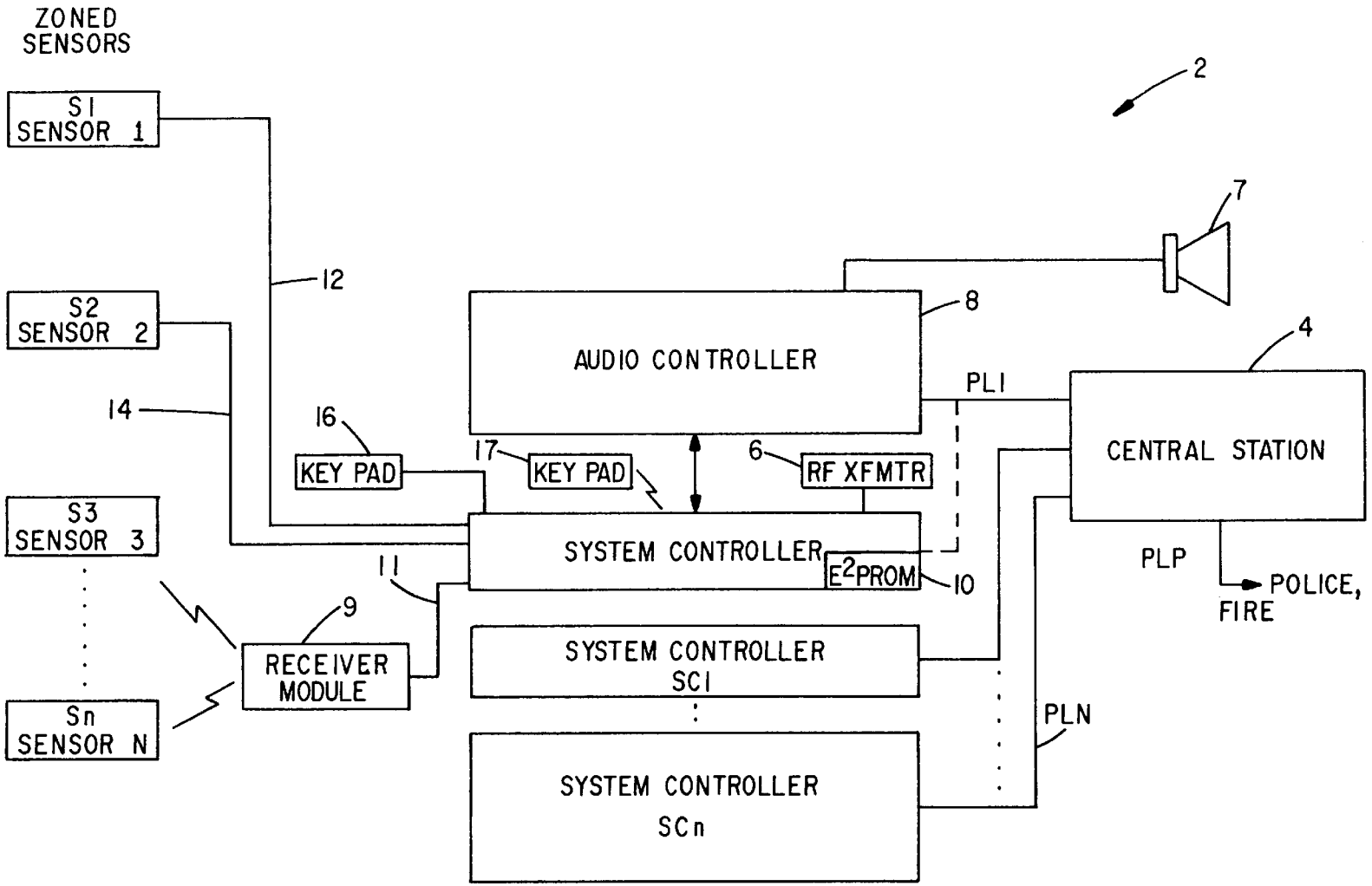
FIG. 1 shows a block diagram to a typical alarm network having a number of system controllers and one of which is coupled to a receiver module which monitors wireless sensor transmissions and the operational integrity of the RF receiver circuitry at the module.

With attention to FIG. 1, a block diagram is shown to a typical alarm network 2. The network 2 includes a number of system controllers SC1 through SCn. Each system controller SC1 to SCn monitors a distinct subscriber and communicates the condition of the monitored premises of each subscriber to a central station 4 via phone lines PL1 to PLn. Operating personnel at the central station 4 monitor the data from each system controller and take appropriate action, depending upon the data received. Such action may comprise dispatching central station personnel, notifying appropriate local police and fire authorities via a phone line PLP, or notifying personnel at the secured premises.

Although shown only at the system controller 10, the system controllers SC1 to SCn can be organized to communicate with one or more of the other system controllers, that is, a "buddy" system via an RF transmitter 6, for example, if the controller's system phone line is inoperative and provided the buddy system controller is mounted within range of the transmitter 6. The transmitter 6 may alternatively comprise an independent wireless communication link to the central station 4.

Similarly, an audio alarm verification capability can be added to each of the system controllers SC1 to SCn via an audio controller 8, such as shown at the system controller 10. The audio controller 8 is hardwired to the system controller 10 at external (I/O) terminals. If the system controller 10 is supplied from Interactive Technologies, Inc., the phone line PL1 is coupled direct to the audio controller 8. Alternatively and as depicted in dashed line, the phone line PL1 can be coupled to the system controller 10. Separate phone lines may also be coupled to each of the audio and system controllers 8 and 10. The audio controller 8 permits the central station 4 to audibly check the secured premises via distributed microphones for false alarms and to communicate with the premises via a local speaker 7. A solid state recording of audio activity at the monitored premises is also maintained to corroborate detected alarms.

Within an exemplary subscriber alarm system that includes the system controller 10, a plurality of alarm sensors, S1 to Sn, communicate with the system controller 10. The sensors S1 and S2 are coupled to the system controller 10 via hardwired conductor paths 12 and 14. A number of wireless sensor transmitters S3 to Sn, which can each be coupled to multiple switch contacts, communicate over radio frequency (RF) communication links with a supervised receiver module 9, see also FIG. 2. The receiver module 9 is hardwired to the system controller 10 to either augment wireless capabilities of the system controller 10 or provide such capabilities to a controller 10 which previously responded only to hardwired sensors. The numbers of available hardwired and wireless sensors within any system will depend upon the capabilities of the supervised receiver module 9 and system controller 10.

Although described below with respect to a discrete receiver module 9, the capabilities of the receiver module 9 might be integrated into a system controller 10. It is also to be appreciated, the receiver module 9 might be constructed to also respond to hardwired sensors, although it presently responds only to wireless sensors.

The sensors S1 to Sn monitor a variety of physical conditions or events at a monitored premises, such as switch actuations (e.g. window, door, or floor mat), motion, temperature, smoke, water, etc.. A hardwired keypad 16 permits a remote programming of the system controller 10 and the receiver module 9. A wireless keypad 17 might also be used to a similar end. The keypad 16 can be responsive to transmissions from both the system controller 10 and supervised receiver module 9 and may include visual displays which convey appropriate messages to the system user.

Each sensor S1 to Sn is uniquely identified to the system controller 10. The wireless sensors S3 to Sn are separately identified to the receiver module 9. The sensors S1 to Sn may be mapped to the system controller 10 in a geographically zoned configuration; that is, in relation to the physical geography of the premises being monitored. A variety of other physical reporting assignments are also possible.

The re-transmission of alarm status and system data by the system controller 10 to the central station 4, in turn, may be prioritized in relation to the criticality of the data. More of the details of the system controller 10, the sensors useable therewith, the central station 4 and possible system configurations and applications are available from pertinent product literature to the system components.

Communications between the system controller 10 and receiver module 9 occur over a three wire bus 11 (i.e. data and ground and positive voltage conductors). The communications are initiated by the system controller 10 with a status request, reference Table I. The receiver module 9 responds with a status reply message, reference Tables II–IV, and wherein the term point is used interchangeably to identify a single sensor. That is, point or "pt" 1 is sensor 1. The status of each point is conveyed with two bits of data. The possible states and interpretations corresponding to the point data is shown at Table V below. The status reply can either be an eight byte message or an extended thirteen byte message, reference FIGS. 3 and 4.

TABLE I

SYSTEM CONTROLLER POLL CONMANDS

| CMD # | Panel Command | Reply | Rcr. Response |
|---|---|---|---|
| 00 | Reset | 07 | RF point status |
| 03 | Current sensor status | 07 | RF point status extd |
| 04 | Latch sensor status | 07 | RF point status extd |
| 15 | Changed sensor status | — | none (if no change) |
| | | 07 | RF point status |

TABLE I-continued

| SYSTEM CONTROLLER POLL CONMANDS | | | |
|---|---|---|---|
| CMD # | Panel Command | Reply | Rcr. Response |
| | | 07 | RF point status extd |
| 22 | Write RF pararneters | 23 | Write RF ack |
| 24 | Rq RF parameters | 25 | RF parameters reply |
| 26 | Learn RF sensor | 27 | Learn RF sensor rply |
| | | 28 | Dup. RF sensor reply |
| 29 | Exit RF learn rnode | | |
| 2A | Rqst RF test rnode | 2B | RF test reply |
| 2C | Exit RF test rnode | — | none |
| 2D | Remove RF sensor | — | none |

TABLE II

RF POINT STATUS REPLY

| BYTE # | NAME | b7 | b6 | b5 | b4 | b3 | b2 | b1 | b0 | DESCRP |
|---|---|---|---|---|---|---|---|---|---|---|
| 1 | addr | | | | | | | | | address |
| 2 | len = 6 | | | | | | | | | byte count |
| 3 | cmd = 07 | | | | | | | | | cmnd # |
| 4 | D1 | pt 1 | pt 1 | pt 2 | pt 2 | pt 3 | pt 3 | pt 4 | pt 4 | sensor sts |
| 5 | D2 | pt 5 | pt 5 | pt 6 | pt 6 | pt 7 | pt 7 | pt 8 | pt 8 | sensor sts |
| 6 | D3 | pt 9 | pt 9 | pt 10 | pt 10 | pt 11 | pt 11 | pt 12 | pt 12 | sensor sts |
| 7 | D4 | pt 13 | pt 13 | pt 14 | pt 14 | pt 15 | pt 15 | pt 16 | pt 16 | sensor sts |
| 8 | chk | | | | | | | | | sum 1–7 |

RF POINT STATUS REPLY EXTENDED

TABLE III

RF POINT STATUS REPLY EXTENDED

| BYTE # | NAME | b7 | b6 | b5 | b4 | b3 | b2 | b1 | b0 | DESCRP |
|---|---|---|---|---|---|---|---|---|---|---|
| 1 | addr | | | | | | | | | address |
| 2 | len = 11 | | | | | | | | | byte count |
| 3 | cmd = 07 | | | | | | | | | cmnd # |
| 4 | D1 | pt | 1 | pt | 2 | pt | 3 | pt | 4 | sensor sts |
| 5 | D2 | pt | 5 | pt | 6 | pt | 7 | pt | 8 | sensor sts |
| 6 | D3 | pt | 9 | pt | 10 | pt | 11 | pt | 12 | sensor sts |
| 7 | D3 | pt | 13 | pt | 14 | pt | 15 | pt | 16 | sensor sts |
| 8 | D5 | pt 8 | pt 7 | pt 6 | pt 5 | pt 4 | pt 3 | pt 2 | pt 1 | 1 = tamper |
| 9 | D6 | pt 16 | pt 15 | pt 14 | pt 13 | pt 12 | pt 11 | pt 10 | pt 9 | 1 = tamper |
| 10 | D7 | pt 8 | pt 7 | pt 6 | pt 5 | pt 4 | pt 3 | pt 2 | pt 1 | 1 = lo bty |
| 11 | D8 | pt 16 | pt 15 | pt 14 | pt 13 | pt 12 | pt 11 | pt 10 | pt 9 | 1 = lo bty |
| 12 | D9 | (Reference Table IV) | | | | | | | | rcr sts** |
| 13 | chk | | | | | | | | | sum of bytes 1 & 2 |

**Sent only if the extended point status bits have changed since the last request or if a request latched status has been issued. Will also be sent if a change has occurred and then changed back.

TABLE IV

RF RECEIVER STATUS

| | b7 | b6 | b5 | b4 | b3 | b2 | b1 | b0 |
|---|---|---|---|---|---|---|---|---|
| b0 | 1 = Receiver tamper | | | | | | | |
| b1 | 1 = reset, no sensors programmed | | | | | | | |
| b2 | 1 = Receiver fail (No sensor data received within supvsd time) | | | | | | | |

TABLE IV-continued

RF RECEIVER STATUS

| | |
|---|---|
| b3 | LSBit of Receiver module version number |
| b4 | Bit 2 of Receiver module version number |
| b5 | MSBit of Receiver module version number |
| b6 | Unused (set = 0) |
| b7 | Unused (set = 0) |

SENSOR STATUS BITS

TABLE V

SENSOR STATUS BITS

| Sensor State | Tamper | Lo Bty | Sensor Status |
|---|---|---|---|
| 00 | x | x | Supervisory/Missing |
| 01 | x | x | Alarm Faulted |
| 10 | x | x | Trouble |
| 11 | x | x | Normal |
| xx | 1 | x | Sensor tamper |
| xx | x | 1 | Sensor Low Battery |

From FIGS. 3 and 4, each message includes address, length and command information, followed by sensor information (i.e. D1 to D4), status information (i.e. D5 to D9) and error checking information. Data bytes D5–D9 provide information to the status of the receiver module 9 and the condition of the tamper switch, battery and the operating condition of the sensor transmitter circuitry. The D5–D9 data are optional status information bytes for exception reporting and are sent as a group. For example, if D5 is present, D6–D9 will also be sent, even if the values are 0. The possible polling commands from the system controllers are shown at Table I. The possible sensor data is shown at Table V.

Bit number 2 of data byte D9 particularly indicates whether the receiver module 9 has received sensor data of any kind within a computed first period of time and from which the operational status of the receiver module 9 can be inferred. In other words, if no RF sensor transmissions are received by the microprocessor 34 within a supervised receiver period of 24 hours divided by the number of sensors in the system, the receiver module 9 transmits a logic high (1) condition at bit 2, which identifies a receiver failed status to the system controller 10. The supervised receiver period is established at a minimum time period of two hours and fractional values are rounded up to the next whole number. Preferrably, the receiver supervisory period is set to provide a sufficient number of transmissions to reasonably distinguish receiver failure from sensor transmitter failures. These typically would occur over a time range of 18–30 hours and during which a sample size of 54–90 supervisory events would be received to distinguish a receiver failure. The determination of a receiver failure can be augmented with a separate analysis of the noise present at the receiver module 9, as discussed in more detail below.

Sensor transmissions occur with the detection of alarm or event conditions. Supervisory transmissions are also sent from each sensor transmitter S3 to Sn approximately once every hour or during a second period (e.g. every 60 to 64 minutes) over a 12 hour period. The supervisory transmissions identify the operating condition of the sensor transmitters and are also used to determine the proper operation of the receiver module 9. More of the details to the latter function are discussed below.

The determination of whether bit 2 of D9 needs to be set is made by the microprocessor 34. A receiver supervisory timer is maintained, separate from a number of sensor supervisory timers, and reset each time any RF sensor transmission is received by the microprocessor 34. Although shown as discrete timers, the sensor and receiver supervisory timers are maintained in the microprocessor 34. If no RF sensor transmissions are received within the receiver supervisory time period, bit 2 is set and transmitted to the system controller 10. With the next status transmission to the central station 4, the receiver failed status is transmitted to the central station 4 for analysis. The receiver failure information might induce central station personnel to transmit a message to another location, such as an off site guard service to check the system and receiver module 9, or possibly to converse with personnel at the site via the audio controller 8, if present in the system.

Figure 2:
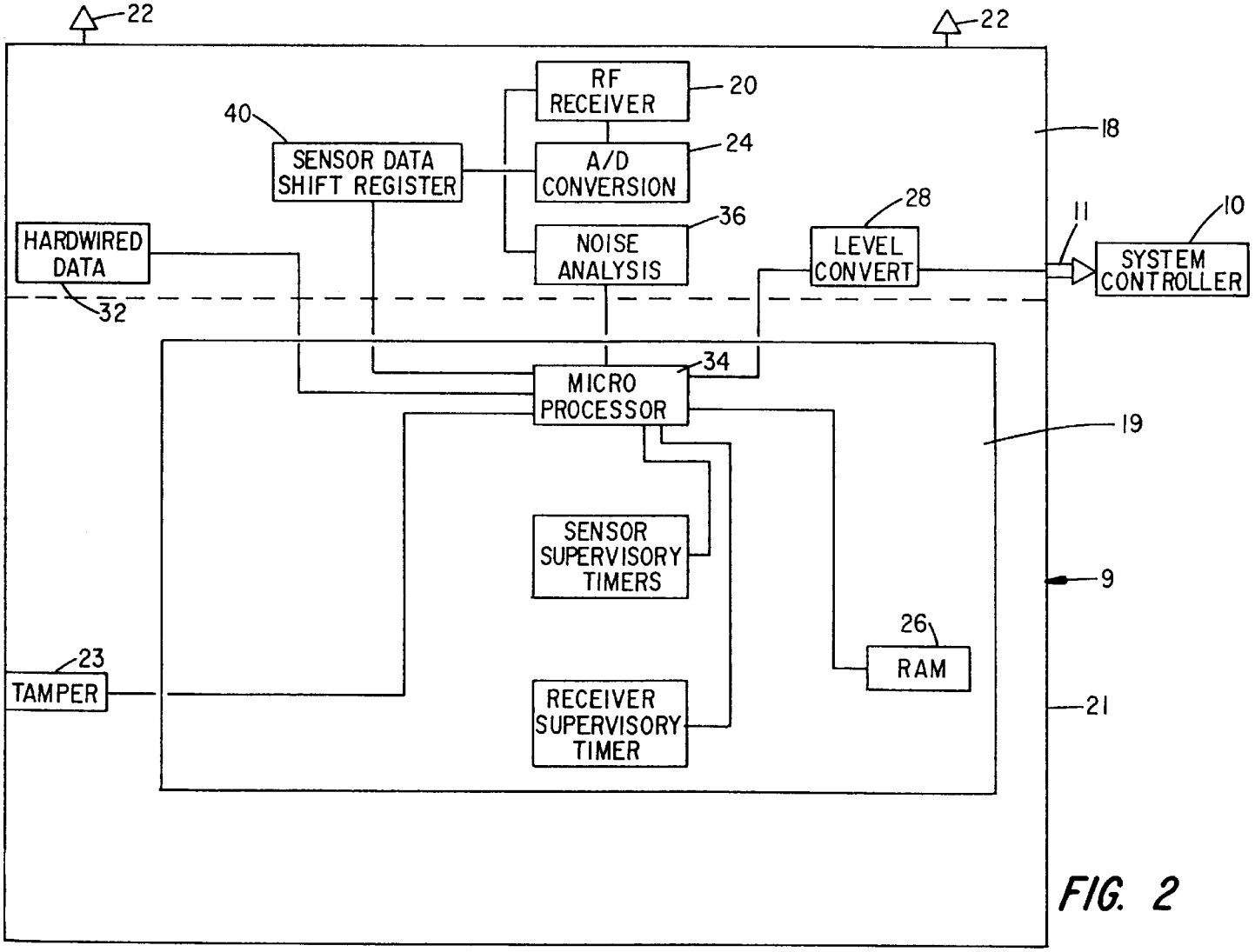
FIG. 2 shows a block diagram to a wireless receiver module which monitors the operation of the wireless receiver circuitry.
Figure 5:
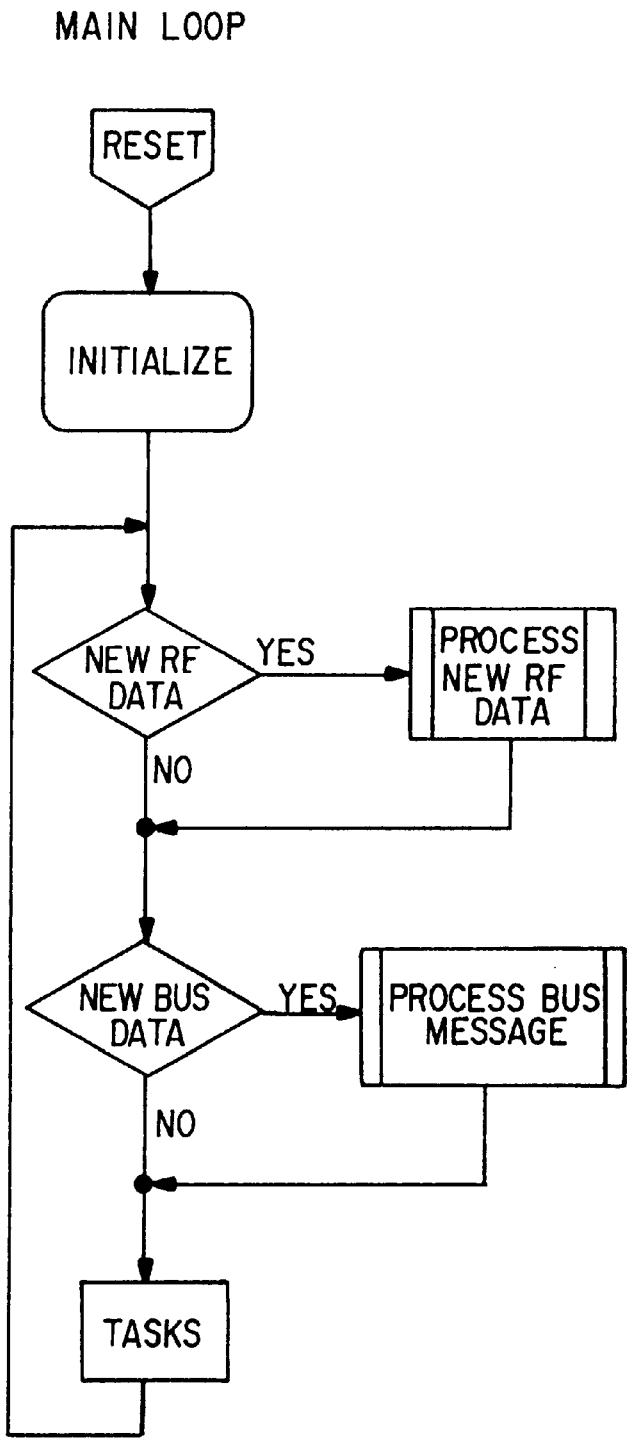
FIG. 5 shows a flow chart to the main loop of the program which controls the receiver module.

With reference to FIG. 2 and mounted within the cabinet 21 that contains the receiver module 9 are separate sections of analog circuitry 18 and digital circuitry 19. Each section 18 and 19 may occupy a number of printed circuit boards. A tamper switch 23 is mounted in conventional fashion to the cover at the cabinet 21.

The analog circuitry 18 includes radio frequency (RF) receiver circuitry 20 which receives RF transmissions from each wireless sensor transmitter S3 to Sn via a pair of antennas 22. The receiver circuitry 20 adjusts a noise floor level relative to ambient noise to detect a series of edges or interrupts which define the data being transmitted to the microprocessor 34. Analog to digital conversion circuitry 24 converts the RF signals, during a data acquisition routine, into digital signals which are processed and stored in a table in random access memory (RAM) 26. RAM memory 26 is updated as data is either received or not received from the sensor transmitters S3 to Sn.

The table includes an addressable listing to the identity of each sensor, event status (i.e. normal, alarm or missing) and receiver tamper. Four status bits define the state of each sensor and two internal flags indicate a state change since the last data request. One flag bit denotes changes in the sensor status and the other denotes changes in the tamper switches and battery conditions at the sensor transmitters.

Level conversion circuitry 28 boosts the logic voltage levels from 5 to 12 volts, prior to coupling the sensor and receiver module data to the bus 11 and the system controller 10. The system controller 10, in turn, communicates via DTMF circuitry and the phone line PL1 with the central station 4 or with the keypads.

Noise monitoring circuitry 36 can be separately coupled to the receiver circuitry 20 to monitor the level or presence of noise as transmissions are received. The circuitry 36 can contain a timer to measure the duration of noiseless interrupts on the data line of the receiver circuitry 20. The lack of noise for a period (e.g. during the receiver supervisory period or possibly a shorter period such as one hour) can suggest a failure at the receiver module 9 and enhance the confidence that the receiver module 9 has failed. The lack of noise might be transmitted as a separate flag with the receiver failure flag, if the supervisory receiver time period has timed out. Alternatively, the duration of the supervisory receiver period might be shortened, such to half of that determined at Table VI, when the noise monitoring circuitry 36 doesn't detect noise. In the latter instance, it is contemplated a minimum period would still apply for the supervisory receiver period to assure a sufficient sampling of transmissions.

Separately provided at the system controller 10 is a non-volatile, $E^2$PROM memory 40 which stores the identification numbers of the sensors coupled to the receiver module 9. The sensor identification numbers of the receiver module 9 can either be manually programmed or learned as each wireless sensor S3-Sn reports to the receiver module 9. Should a system power failure occur, the data at the $E^2$PROM memory is used to reload the RAM memory 26 with the appropriate sensor ID numbers for the system.

The operations of the receiver module 9 are controlled by the microprocessor 34. Microcoded operating instructions are stored in associated memory. The flow charts of FIGS. 5 through 8 and the source code listing at Appendix A further describe the operations performed to identify whether the receiver module 9 has failed.

Separate from the collection of sensor data, the microprocessor 34 in a slave capacity responds to the data requests from the system controller 10 over the bus 11. A separate microprocessor within the system controller 10 controls the primary operation of the system.

As the RF receiver 20 receives RF transmissions from the sensors S3 to Sn, the transmissions are converted into digital signals for processing. The signals are converted by measuring the time separation between RF pulses that comprise each transmission. The time between pulses indicates whether a logic high (1) or a low (0) is received. As the sequential pulses are received, a counter is reset, the time values are calculated and the data bits are saved at a data collection shift register 40. Although shown as a discrete device, the shift register 40 is included at the microprocessor 34. This continues until a predetermined number of data bits constituting a valid message are collected at the shift register 40. Upon filling the data shift register 40, the microprocessor 34 is notified by setting a NEW DATA RF flag, reference FIG. 5.

Figure 6A:
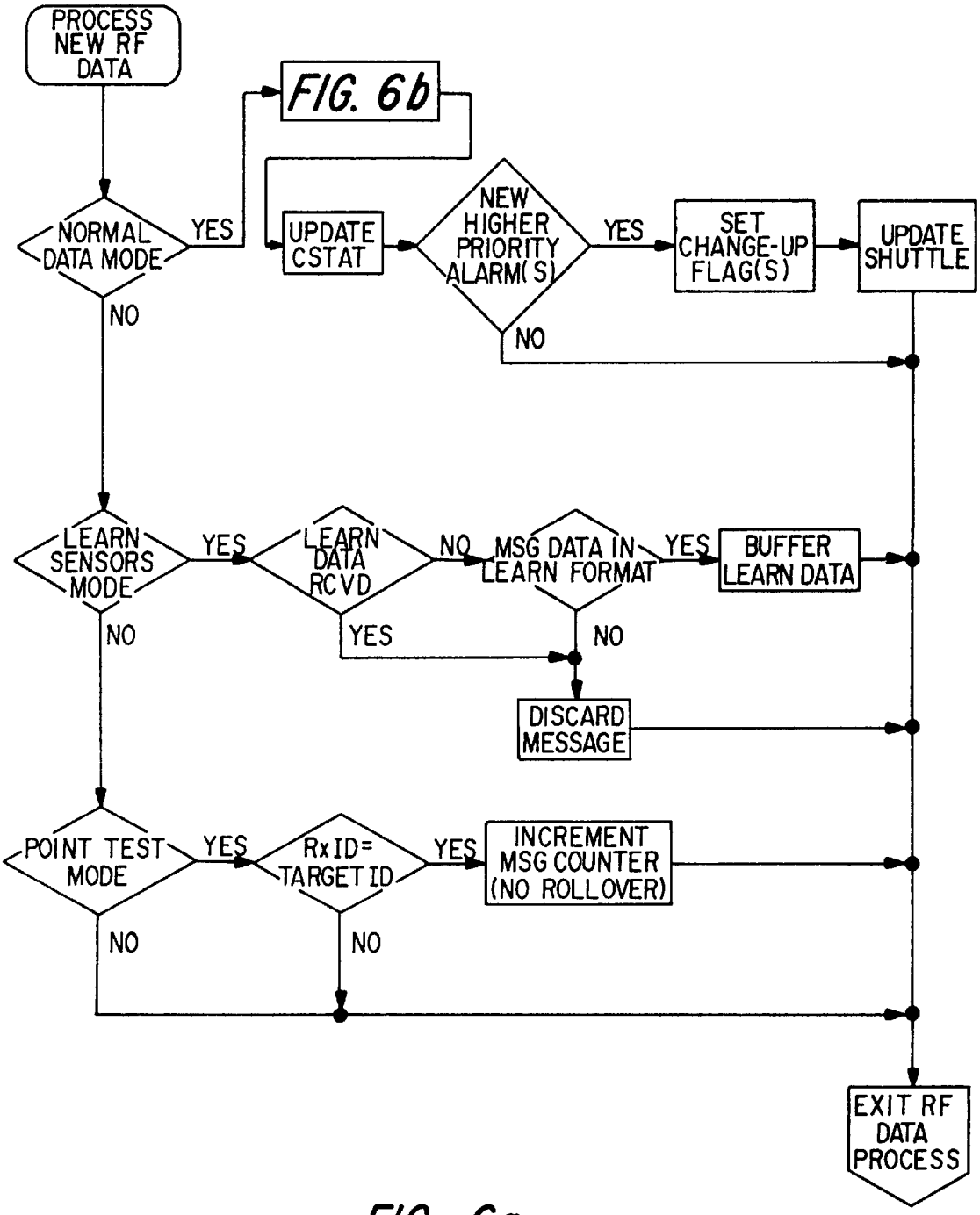
FIGS. 6*a* and 6*b* shows a flow chart to the portion of the receiver program which processes NEW RF DATA from the wireless sensors.
Figure 6B:
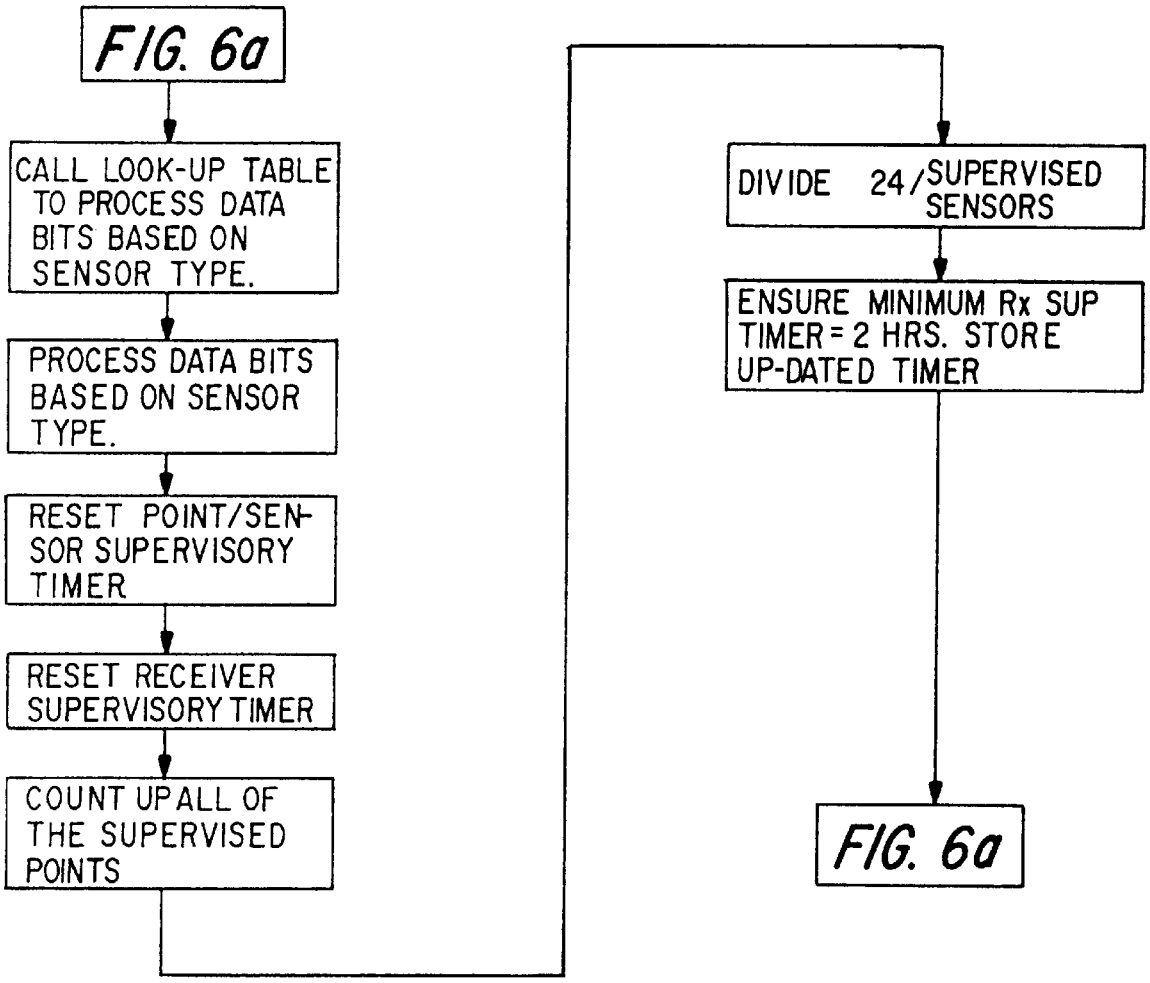

With the setting of the NEW RF DATA flag, the Main Loop of the receiver module program initiates a PROCESS NEW RF DATA routine, reference FIGS. 6*a* and 6*b*, wherein current status (CSTAT) and shuttle segments of RAM 26 are updated and the NEW BUS DATA flag may be set. When a status request is next received, the program performs a PROCESS BUS MESSAGE routine, reference FIGS. 7*a* and 7*b*.

During the RF data processing routine, each transmission is verified as coming from a valid sensor by comparing the identification data in the message to the sensor ID values stored in RAM 26. If a valid sensor is detected, the sensor's status is updated at RAM 26 to the current status and the time when the transmission was received. If neither an alarm or event message nor supervisory message is received within each sensor's supervisory period, the sensor status condition is set to a missing condition (00), reference Table V.

A supervisory message is structured the same as an event driven transmission and includes sensor specific identification data, sensor tamper data and low battery data. Also included are at least one preamble or start bit and at least one error checking bit. Each supervisory transmission is transmitted in triplicate as a message packet for redundancy. The period of a sensor supervisory timer is reset after any transmission from each sensor transmitter S3 to Sn.

Regardless of event transmissions, the receiver module 9 expects at least one supervisory transmission from each sensor transmitter once approximately every hour. If no transmissions are received, a problem can exist at either the receiver module or the sensor transmitters. With multiple sensors in the system, the problem may be narrowed to a particular sensor, if messages are being received from other sensors. If, however, no messages are being received, the system controller 10 does not know whether all sensors or the receiver module 9 has failed.

Problems with the receiver module 9 might be loss of power to the microprocessor 34 or a broken connection between the analog and digital sections 18 and 19. Also, even if the analog circuitry 18 stops working, communications between the receiver module 9 and system controller 10 will continue and the system controller 10 will receive MISSING SENSOR X messages, even though the sensors are operating properly. The availability of the receiver failure flag therefore provides the system controller 10 with an early warning to the potential failure of the receiver module 9.

The receiver failure or supervisory function is implemented in the receiver module 9 with a separate 24/# Sn or receiver supervisory timer at the microprocessor 34 which monitors the occurrence of sensor transmissions relative to the timer. If neither event nor supervisory transmissions are received from any sensor transmitters S3 to Sn within a certain time determined in relation to the number of sensors coupled to the system, the receiver failure flag is reported.

Through statistical analysis and empirical testing, an adequate time period for inferring analog circuit failure can be obtained by dividing 24 hours by the number of sensors in the system with a minimum time period of two hours. Values having a fractional portion are rounded up to the next whole number. Table VI sets out exemplary monitoring period for systems with differing numbers of sensors.

TABLE VI

RECEIVER SUPERVISORY PERIOD

| # OF SENSORS | HOURS |
|---|---|
| 1 | 24 |
| 2 | 12 |
| 3 | 8 |
| 4 | 6 |
| 5 | 5 |
| 6 | 4 |
| 7 | 4 |
| 8 | 3 |
| 9 | 3 |
| 10 | 3 |
| 11 | 3 |
| 12 | 2 |
| >12 | 2 |

Receiver failure and missing sensor status updates are performed during a one MSEC TIMER INTERRUPT routine via an interrupt timer. If no sensor transmissions are received when the timer reaches one hour, supervisory time period values stored in RAM 26 and assigned to the receiver module and to each of the sensor transmitters S3 through Sn are decremented. The supervisory or failure period for the receiver module 9 is determined in relation to Table VI. When either or both the time values for the receiver module 9 or the sensor transmitters S3 to Sn have been decremented to zero, the appropriate RECEIVER FAILURE and MISSING SENSOR X status flags are set in a current status memory area (CSTAT) in RAM 26. The SHUTTLE memory area in RAM 26 is also updated.

Turning attention to FIGS. 5 through 8, with the receipt of any wireless event transmission or supervisory transmission and prior to the time out of the shortest supervisory value assigned to either the receiver module or sensors, the transmitting sensor's supervisory time value is reset to its start value during the Process New RF Data routine. The supervisory time value of the receiver module 9 is also reset to its start value, reference FIGS. 6*a* and 6*b* and Appendix A. The current status CSTAT memory area is separately updated with the new sensor and receiver status information. The shuttle memory is used to separately form a status reply message and is updated only if the new sensor information contains a higher priority alarm than previously loaded.

Figure 7A:
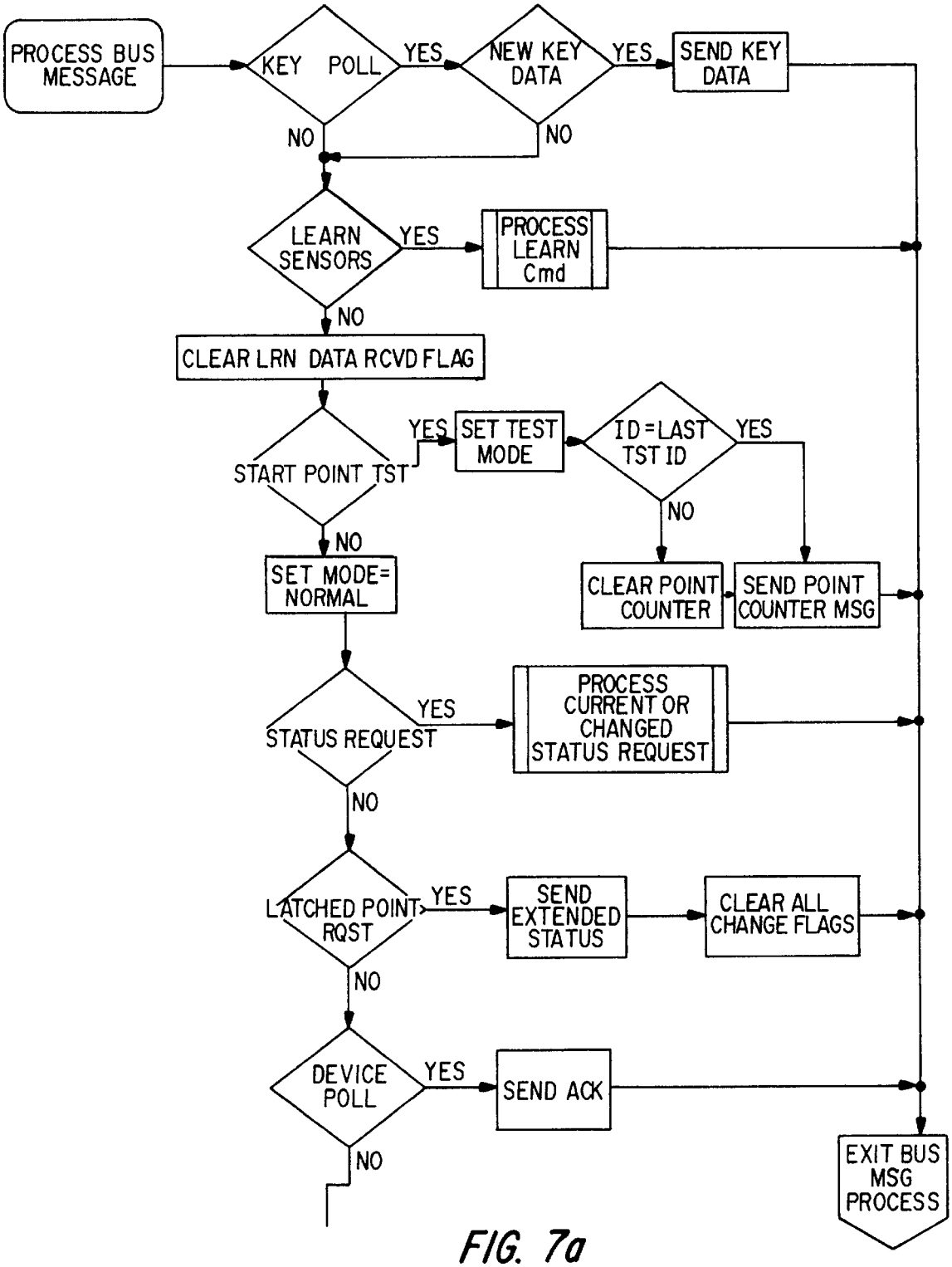
FIGS. 7*a* and 7*b* show a flow chart to the portion of the receiver program which processes BUS MESSAGES.
Figure 7B:
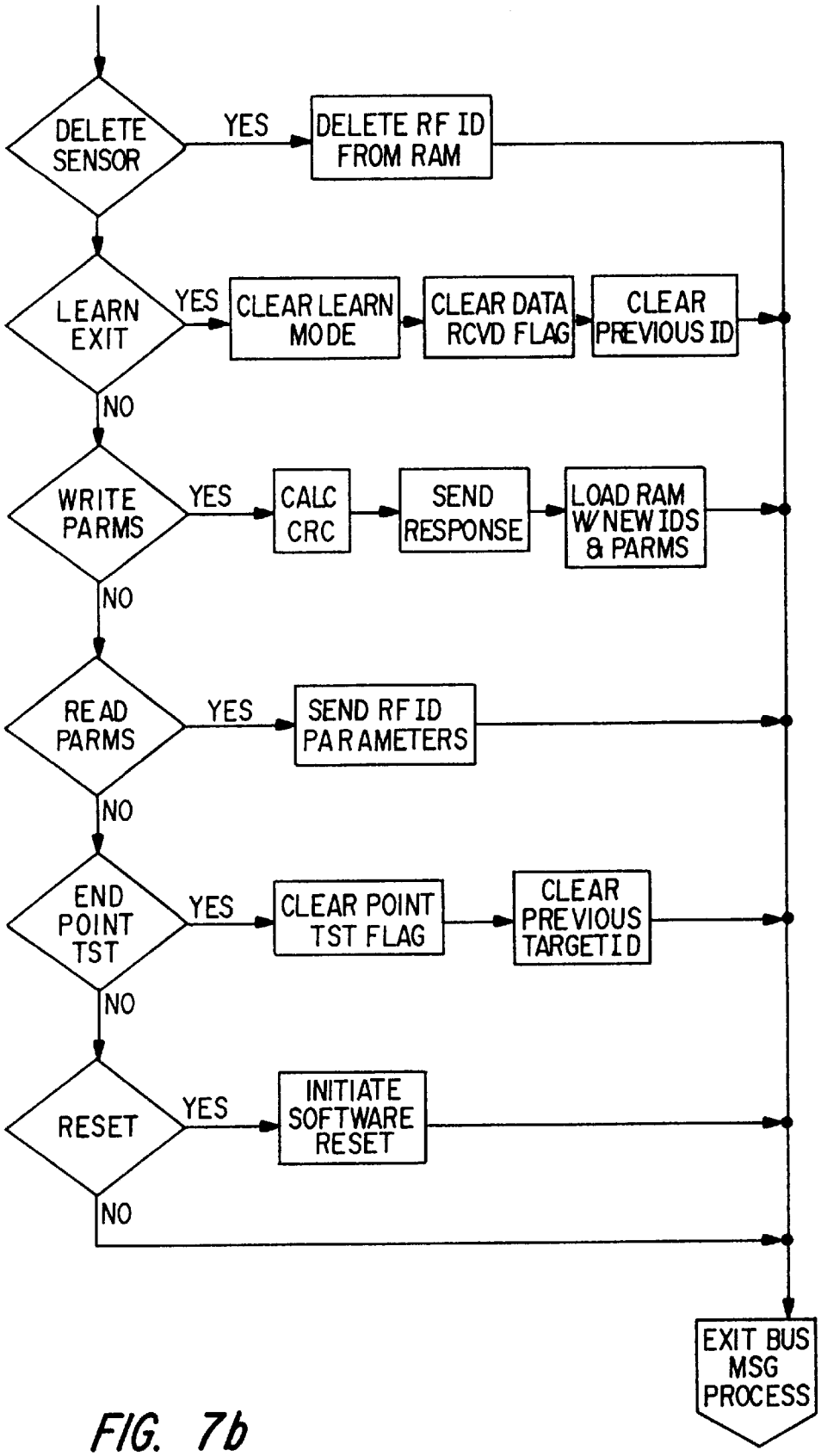
Figure 8:
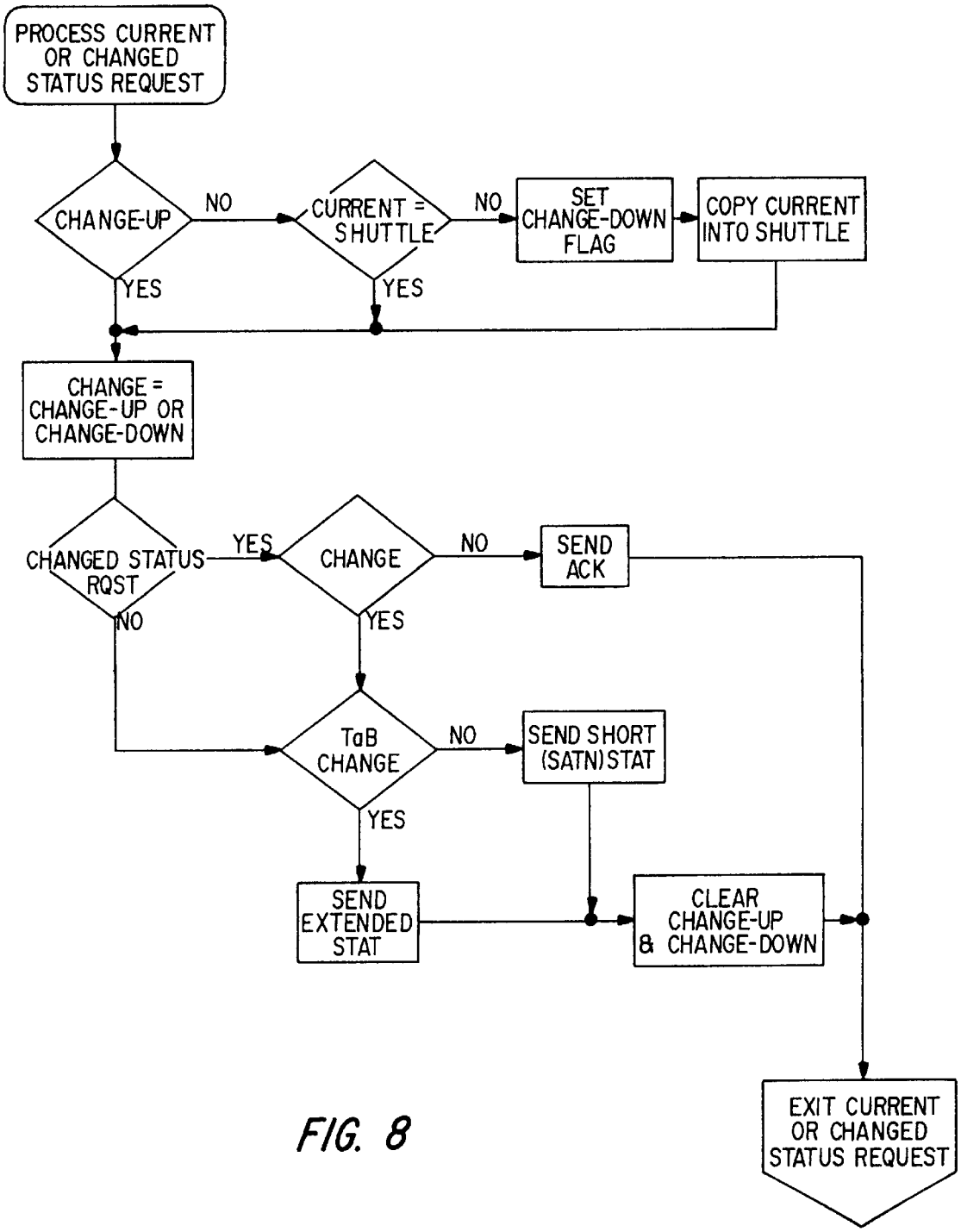
FIG. 8 shows a flow chart to the operation of the processor at the receiver module which processes CURRENT OR CHANGED STATUS REQUESTS.

With the receipt of a current or changed STATUS REQUEST at bus 11, a NEW BUS DATA flag is set which causes the microprocessor 34 to enter the PROCESS BUS MESSAGE routine, FIGS. 7*a* and 7*b*. The microprocessor 34 reads the polled message, clears a LRN DATA RCVD Flag and sets the MODE to NORMAL. The microprocessor 34 then branches to the PROCESS CURRENT OR CHANGED STATUS REQUEST routine, reference FIG. 8, to select and couple the proper data to the system controller 10.

During the PROCESS CURRENT OR CHANGED STATUS REQUEST routine, the microprocessor 34 configures the status reply message. It first determines whether a CHANGE-UP flag was set in the PROCESS NEW RF DATA routine. If no CHANGE-UP flag was set, the CSTAT data is compared to the data stored in the shuttle memory. If they are unequal, a CHANGE-DOWN flag is set and the CSTAT data is copied into the shuttle memory.

After the shuttle memory is ready, the program looks to see if the controller 10 is asking whether a status change occurred. If it is and no changes have occurred, the status request is simply acknowledged. If changes have occurred or if the controller 10 is asking for other than changes, the program branches to determine whether a short or extended message should be transmitted. If either a sensor tamper and/or battery change flag or a receiver module failure flag has been set, the extended thirteen byte reply is sent. Otherwise, the eight byte reply is sent and the PROCESS CURRENT OR CHANGED STATUS REQUEST routine is exited back to the Main Loop, after clearing the change-up and change-down flags.

If a receiver failure flag is transmitted with the reply, the system controller 10 upon receiving notice to the condition normally notifies personnel to physically check the receiver module 9. An early warning is thereby obtained in advance of waiting until MISSING SENSOR X data is received from all the sensors S3 to Sn.

While the invention has been described with respect to its presently preferred construction, it is to be appreciated various alternative constructions might be suggested to those skilled in the art. The following claims should therefore be interpreted to include all those equivalent embodiments within the spirit and scope thereof.

What is claimed is:

1. In a security alarm network including a central station which communicates with a subscriber system controller and including a plurality of RF sensors distributed about a subscriber premises identified to communicate with the system controller, apparatus comprising, RF means coupled to said subscriber system controller for receiving RF transmissions from said RF sensors and including 1) first means for monitoring RF transmissions from said RF sensors during a first period, wherein the duration of said first period is determined as a function of the number of RF sensors identified to said system controller, wherein said first period is defined independent of a status transmission means which separately monitors the operating condition of each RF sensor during a status transmission period, 2) means for resetting said first period upon receipt of an RF transmission from any of said RF sensors, and 3) means for flagging a receiver failure condition, upon a timing out of said first period, and for coupling a data message defining the receiver failure condition and RF sensor status data to said system controller, whereby the system controller can distinguish a receiver malfunction from a sensor transmitter failure.

2. A security alarm network as set forth in claim 1 wherein said first period comprises a period selected in the range of eighteen to thirty hours and divided by the number of RF sensors identified to said system controller.

3. A security alarm network as set forth in claim 2 wherein said first period comprises a period of twenty four hours divided by the number of RF sensors identified to said system controller and is greater than a predetermined minimum period.

4. A security alarm network as set forth in claim 2 wherein said network includes nonvolatile memory means for storing the identities of said alarm sensors identified to said system controller and restoring said identities upon the occurrence of a power failure.

5. A security alarm network as set forth in claim 2 wherein said RF means includes tamper means for monitoring a tamper condition of each RF sensor and wherein said data message defines said tamper condition and means for monitoring said tamper means and including data indicative of a tamper condition in said data message.

6. A security alarm network as set forth in claim 1 including means for monitoring noise present at said RF transmissions to augment the distinguishing of a receiver malfunction.

7. A security alarm network as set forth in claim 6 including means responsive to the lack of noise during the receipt of RF transmissions for changing the duration of said first period.

8. In a security alarm network including a central station which communicates with a subscriber system controller and including a plurality of RF sensors distributed about a subscriber premises identified to communicate with the system controller, apparatus comprising, RF means coupled to said subscriber system controller for receiving RF transmissions from said plurality of RF sensors and including 1) first means for monitoring said RF transmissions from said RF sensors during a first period, wherein the duration of said first period is determined as a function of the number of RF sensors identified to said system controller, wherein said first period is defined independent of a status transmission means which monitors the operating condition of each RF sensor during a status transmission period, and wherein said first period is less than said status transmission period, 2) means for resetting said first period upon receipt of an RF transmission from any of said RF sensors, and 3) means for flagging a receiver failure condition, upon a timing out of said first period, and for coupling a data message defining the receiver failure condition and RF sensor status data to said system controller, whereby the system controller can distinguish a receiver malfunction from a sensor transmitter failure.

9. A security alarm network as set forth in claim 8 wherein said first period comprises a period selected in the range of eighteen to thirty hours and divided by the number of RF sensors identified to said system controller.

10. A security alarm network as set forth in claim 9 wherein said first period comprises a period of twenty four hours and divided by the number of RF sensors identified to said system controller and is greater than a minimum period.

11. A security alarm network as set forth in claim 8 including means for monitoring noise present at said RF transmissions to augment the distinguishing of a receiver malfunction.

12. A security alarm network as set forth in claim 11 including means responsive to the lack of noise during the receipt of RF transmissions for changing the duration of said first period.

13. In a security alarm network including a central station which communicates with a subscriber system controller and including a plurality of RF sensors distributed about a subscriber premises identified to communicate with the system controller, apparatus comprising, RF means coupled to said subscriber system controller for receiving RF transmissions from said RF sensors and including 1) first means for monitoring RF transmissions from said RF sensors during a first period, wherein the duration of said first period equals 24 hours divided by the number of RF sensors identified to said system controller, 2) second means for monitoring RF transmissions from said plurality of RF sensors and the operating status condition of each RF sensor during a status transmission period, 3) means for resetting said first period upon receipt of an RF transmission from any of said RF sensors, 4) noise means for monitoring noise present at said RF transmissions, and 5) means responsive to said noise means for flagging a receiver failure condition upon the timing out of said first period or lack of noise and for coupling a data message defining the receiver failure condition and RF sensor status data to said system controller, whereby the system controller can distinguish a receiver malfunction from a sensor transmitter failure.

14. A security alarm network as set forth in claim 13 wherein said RF means includes tamper means for monitoring a tamper condition of each RF sensor and wherein said data message defines said tamper condition.

15. A security alarm network as set forth in claim 13 including means responsive to said noise means and the lack of noise during the receipt of RF transmissions for reducing the duration of said first period and to a value greater than a minimum period.

16. In a security alarm network including a central station which communicates with a subscriber system controller and including a plurality of sensors distributed about a subscriber premises identified to communicate with the system controller, apparatus comprising, RF means coupled to said subscriber system controller for receiving RF transmissions from said plurality of RF sensors and including 1) first means for monitoring RF transmissions from said RF sensors during a first period, wherein the duration of said first period is determined as a function of the number of RF sensors identified to said system controller, 2) means for resetting said first period upon receipt of an RF transmission from any of said RF sensors, 3) noise means for monitoring noise present at said RF means, and 4) means responsive to said first means and said noise means for flagging a receiver failure condition upon the timing out of said first period or detecting a lack of noise and for coupling a data message defining the receiver failure condition and RF sensor status data to said system controller, whereby the system controller can distinguish a receiver malfunction from a sensor transmitter failure.

17. In a security alarm network including a central station which communicates with a subscriber system controller and including a plurality of RF sensors distributed about a subscriber premises identified to communicate with the system controller, apparatus comprising, RF means coupled to said subscriber system controller for receiving RF transmissions from said RF sensors and including 1) first means for monitoring RF transmissions from said RF sensors during a first period, wherein the duration of said first period equals 24 hours divided by the number of RF sensors identified to said system controller, 2) means for simultaneously monitoring sensor status transmissions from each of said plurality of RF sensors, 3) means for resetting said first period upon receipt of an RF transmission from any of said RF sensors, 4) noise means for monitoring noise present at said RF means, 5) means responsive to said first means and said noise means for flagging a receiver failure condition upon the timing out of said first period or lack of noise and for coupling a data message defining the receiver failure condition and RF sensor status data to said system controller, and 6) means responsive to said noise means and the lack of noise at said RF means for reducing the duration of said first period to value greater than a predetermined minimum period, whereby the system controller can distinguish a receiver malfunction from a sensor transmitter failure.

* * * * *